US011660873B2

(12) United States Patent
Koshikawa et al.

(10) Patent No.: US 11,660,873 B2
(45) Date of Patent: May 30, 2023

(54) LIQUID EJECTION APPARATUS

(71) Applicant: CANON KABUSHIKI KAISHA, Tokyo (JP)

(72) Inventors: Hiroshi Koshikawa, Kanagawa (JP); Hiroki Hayashi, Kanagawa (JP); Hiroshi Yamada, Kanagawa (JP); Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 17/208,822

(22) Filed: Mar. 22, 2021

(65) Prior Publication Data

US 2021/0300055 A1 Sep. 30, 2021

(30) Foreign Application Priority Data

Mar. 27, 2020 (JP) ..... JP2020-057121

(51) Int. Cl.
*B41J 2/175* (2006.01)

(52) U.S. Cl.
CPC .. *B41J 2/17566* (2013.01); *B41J 2002/17576* (2013.01)

(58) Field of Classification Search
CPC ..... B41J 2/17566; B41J 2002/17576; B41J 2002/17573; B41J 2/17513; B41J 2/17523; B41J 29/13
USPC ..... 347/85
See application file for complete search history.

(56) References Cited

U.S. PATENT DOCUMENTS 6,270,206 B1 8/2001 Shimizu et al. ..... 347/86
6,293,663 B1 9/2001 Koshikawa et al. ..... 347/86
6,325,500 B1 12/2001 Kitabatake et al. ..... 347/86
6,347,865 B1 2/2002 Matsumoto et al. ..... 347/86
6,350,025 B1 2/2002 Morita et al. ..... 347/86
6,382,783 B1 5/2002 Hayashi et al. ..... 347/85
6,390,601 B1 5/2002 Morita et al. ..... 347/49
6,402,298 B1 6/2002 Nanjo et al. ..... 347/49
6,422,674 B1 7/2002 Hinami et al. ..... 347/7
6,443,567 B1 9/2002 Hayashi et al. ..... 347/85
6,447,084 B1 9/2002 Uetsuki et al. ..... 347/7
6,450,631 B1 9/2002 Hayashi et al. ..... 347/86
(Continued)

FOREIGN PATENT DOCUMENTS

JP 2019-025818 2/2019

OTHER PUBLICATIONS

U.S. Appl. No. 17/208,763, filed Mar. 22, 2021.
U.S. Appl. No. 17/243,351, filed Apr. 28, 2021.

*Primary Examiner* — Matthew Luu
*Assistant Examiner* — Alexander D Shenderov
(74) *Attorney, Agent, or Firm* — Venable LLP

(57) ABSTRACT

A technique with which deterioration in a function of detecting the remaining amount of liquid can be prevented even in a case where the liquid is thickened or solidified is to be provided. A liquid ejection apparatus is provided with a liquid ejection head configured to eject supplied liquid, a storage unit configured to store the liquid to be supplied to the liquid ejection head, a pivot member configured to be immersed in the liquid stored in the storage unit and be revolvable according to the amount of the liquid, and a detection unit configured to detect the amount of the liquid by use of the pivot member, and the liquid ejection apparatus includes a pivot unit configured to force the pivot member to pivotally move.

11 Claims, 5 Drawing Sheets

(56) References Cited

U.S. PATENT DOCUMENTS

| | | | | |
|---|---|---|---|---|
| 6,454,400 | B1 | 9/2002 | Morita et al. | 347/86 |
| 6,471,343 | B1 | 10/2002 | Shimizu et al. | 347/85 |
| 6,474,797 | B2 | 11/2002 | Kurata et al. | 347/85 |
| 6,485,136 | B1 | 11/2002 | Shimizu et al. | 347/86 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,540,321 | B1 | 4/2003 | Hirano et al. | 347/22 |
| 6,540,342 | B2 | 4/2003 | Koshikawa et al. | 347/86 |
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,629,758 | B2 | 10/2003 | Okamoto et al. | 347/85 |
| 6,637,872 | B2 | 10/2003 | Ara et al. | 347/85 |
| 6,655,542 | B2 | 12/2003 | Koshikawa et al. | 220/661 |
| 6,692,115 | B2 | 2/2004 | Sanada et al. | 347/85 |
| 6,698,871 | B1 | 3/2004 | Hayashi et al. | 347/86 |
| 6,702,427 | B2 | 3/2004 | Shimizu et al. | 347/50 |
| 6,705,715 | B2 | 3/2004 | Morita et al. | 347/87 |
| 6,709,092 | B2 | 3/2004 | Hayashi et al. | 347/86 |
| 6,712,458 | B2 | 3/2004 | Hatasa et al. | 347/86 |
| 6,719,415 | B1 | 4/2004 | Hattori et al. | 347/86 |
| 6,742,857 | B2 | 6/2004 | Koshikawa et al. | 347/19 |
| 6,746,110 | B2 | 6/2004 | Hayashi | 347/86 |
| 6,755,500 | B2 | 6/2004 | Hirano et al. | 347/22 |
| 6,796,645 | B2 | 9/2004 | Hayashi et al. | 347/86 |
| 6,805,434 | B2 | 10/2004 | Hayashi et al. | 347/85 |
| 6,815,381 | B1 | 11/2004 | Yamamoto et al. | 442/187 |
| 6,824,258 | B2 | 11/2004 | Yamamoto et al. | 347/86 |
| 6,827,431 | B2 | 12/2004 | Kitabatake et al. | 347/86 |
| 6,851,798 | B2 | 2/2005 | Koshikawa et al. | 347/85 |
| 6,863,762 | B2 | 3/2005 | Sanada et al. | 156/180 |
| 6,877,847 | B2 | 4/2005 | Hayashi et al. | 347/86 |
| 6,877,848 | B2 | 4/2005 | Shimizu et al. | 347/86 |
| 6,921,161 | B2 | 7/2005 | Morita et al. | 347/86 |
| 6,942,326 | B2 | 9/2005 | Hayashi et al. | 347/86 |
| 6,966,631 | B2 | 11/2005 | Matsuo et al. | 347/49 |
| 6,997,548 | B2 | 2/2006 | Matsuo et al. | 347/86 |
| 7,118,194 | B2 | 10/2006 | Matsuo et al. | 347/49 |
| 7,134,747 | B2 | 11/2006 | Hayashi et al. | 347/86 |
| 7,165,829 | B2 | 1/2007 | Hayashi et al. | 347/49 |
| 7,293,865 | B2 | 11/2007 | Tsukuda et al. | 347/86 |
| 8,011,768 | B2 | 9/2011 | Hayashi et al. | 347/86 |
| 8,439,491 | B2 | 5/2013 | Hayashi et al. | 347/86 |
| 8,485,642 | B2 | 7/2013 | Hayashi et al. | 347/49 |
| 8,529,037 | B2 | 9/2013 | Miyashita et al. | 347/86 |
| 8,960,869 | B2 | 2/2015 | Takada et al. | 347/86 |
| 9,333,758 | B2 | 5/2016 | Koshikawa et al. | B41J 2/1752 |
| 9,597,884 | B2 | 3/2017 | Nanjo et al. | B41J 2/17526 |
| 9,724,929 | B2 | 8/2017 | Yoshii et al. | B41J 2/1752 |
| 9,821,562 | B2 | 11/2017 | Nanjo et al. | B41J 2/17523 |
| 9,840,082 | B2 | 12/2017 | Nanjo et al. | B41J 2/17513 |
| 9,908,338 | B2 | 3/2018 | Koshikawa et al. | B41J 2/17559 |
| 9,919,536 | B2 | 3/2018 | Miyashita et al. | B41J 2/17523 |
| 10,029,474 | B2 | 7/2018 | Takada et al. | B01D 19/0073 |
| 10,160,222 | B2 | 12/2018 | Shiba et al. | B41J 2/17566 |
| 10,207,511 | B2 | 2/2019 | Nanjo et al. | B41J 2/175 |
| 10,336,087 | B2 | 7/2019 | Miyashita et al. | B41J 2/17509 |
| 10,391,776 | B2 | 8/2019 | Hayashi et al. | B41J 2/17513 |
| 10,618,293 | B2 | 4/2020 | Koshikawa et al. | G03G 15/0886 |
| 10,675,882 | B2 | 6/2020 | Shiba et al. | B41J 2/17566 |
| 10,836,175 | B2 | 11/2020 | Miyashita et al. | B41J 2/17553 |
| 10,994,548 | B2 | 5/2021 | Iinuma et al. | B41J 2/175 |
| 2002/0089555 | A1* | 7/2002 | Kobayashi | B41J 2/17523 347/7 |
| 2003/0038867 | A1 | 2/2003 | Yamamoto et al. | 347/86 |
| 2010/0110154 | A1* | 5/2010 | Iwamura | B41J 29/38 347/86 |
| 2019/0030910 | A1 | 1/2019 | Tanabe et al. | B41J 2/17566 |

* cited by examiner

LIQUID EJECTION APPARATUS

BACKGROUND OF THE DISCLOSURE

Field of the Disclosure

The present disclosure relates to a liquid ejection apparatus that is widely applicable, for example, as an inkjet printing apparatus including a print head capable of ejecting ink in an inkjet system.

Description of the Related Art

In Japanese Patent Laid-Open No. 2019-025818, there is disclosed a technique in which a member including a float having a specific gravity smaller than that of ink is included in a revolvable manner inside a chamber for storing ink, and pivotal movement of this member is detected by a sensor, so that the remaining amount of the ink inside the chamber is detected. Specifically, in the technique disclosed in Japanese Patent Laid-Open No. 2019-025818, a detected part of the pivot member is detected by the sensor, so that whether or not the liquid surface of the ink inside the chamber is equal to or higher than a predetermined height is detected.

SUMMARY OF THE DISCLOSURE

A liquid ejection apparatus is provided with a liquid ejection head configured to eject supplied liquid, a storage unit configured to store the liquid to be supplied to the liquid ejection head, a pivot member configured to be immersed in the liquid stored in the storage unit and be revolvable according to an amount of the liquid, and a detection unit configured to detect the amount of the liquid by use of the pivot member, and the liquid ejection apparatus includes a pivot unit configured to force the pivot member to pivotally move.

Further features of the present disclosure will become apparent from the following description of exemplary embodiments with reference to the attached drawings.

DESCRIPTION OF THE EMBODIMENTS

However, in the technique disclosed in Japanese Patent Laid-Open No. 2019-025818, a pivotal shaft of the pivot member is disposed in the vicinity of the bottom section of the chamber. Therefore, shortly before the ink inside the chamber runs out, the liquid surface of the ink is located on the pivotal shaft. Therefore, if the ink inside the chamber is let stand for a long period of time in a state shortly before running out, there is a possibility that the ink around the pivotal shaft becomes thickened or solidified, which makes it difficult for the pivot member to make a pivotal movement, so that the function of detecting the ink remaining amount is deteriorated.

The present disclosure has been made in view of the above-described problem, so as to provide a technique capable of preventing deterioration in the function of detecting the remaining amount of ink even though the ink is thickened or solidified.

Hereinafter, with reference to the accompanying drawings, a detailed explanation will be given of an example of a liquid ejection apparatus according to the present disclosure. Note that it is not intended that the following embodiments limit the present disclosure, and every combination of the characteristics explained in the embodiments is not necessarily essential to the solution in the present disclosure. In addition, unless otherwise specified, the relative positions, shapes, etc., of the constituent elements described in the present embodiments are merely examples and are not intended to limit the range of the present disclosure as such.

First Embodiment

Figure 1A:
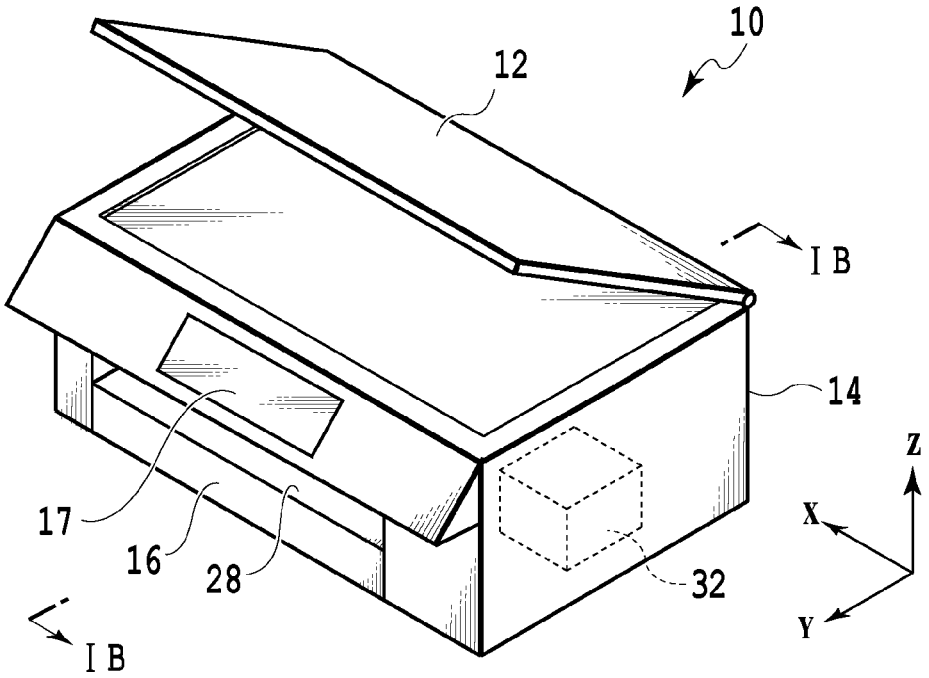
FIG. 1A and FIG. 1B are diagrams for explaining an overview of a configuration of a printing apparatus, which is an example of a liquid ejection apparatus according to an embodiment.
Figure 1B:
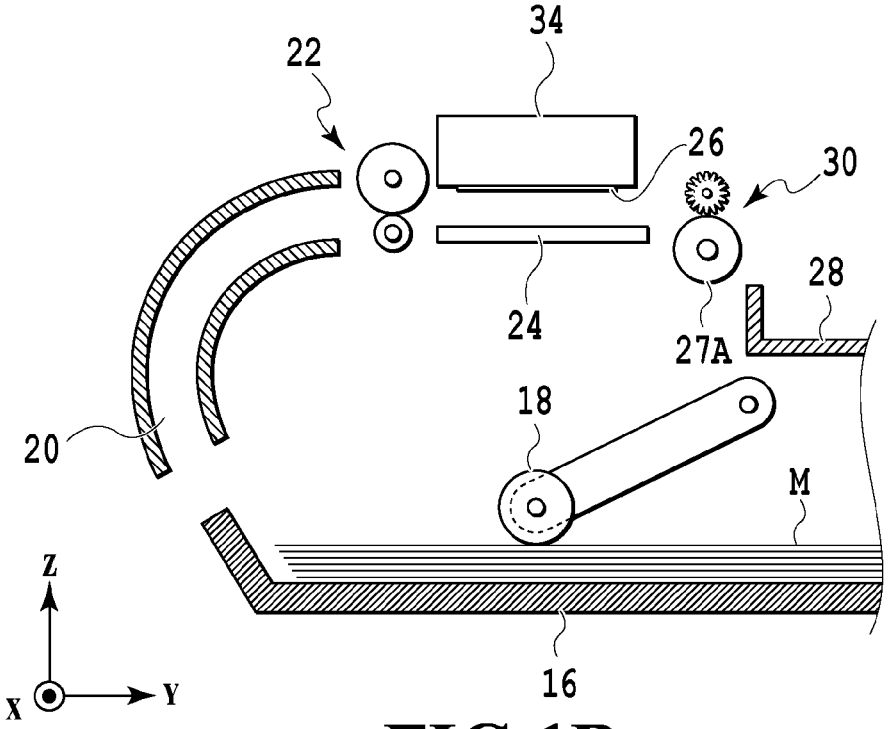

First, with reference to FIG. 1A through FIG. 4B, an explanation will be given of the liquid ejection apparatus according to the first embodiment. Note that, in the specification of the present application, a printing apparatus that ejects ink onto a print medium for printing is taken as an example of the liquid ejection apparatus for the sake of explanation. FIG. 1A and FIG. 1B are diagrams for explaining an overview of the printing apparatus according to the embodiment. FIG. 1A is a perspective view, and FIG. 1B is a diagram for explaining the configuration of the printing part. Note that the printing apparatus of FIG. 1A and FIG. 1B is an example of the printing apparatus to which the present embodiment can be applied, and the printing apparatus to which the present embodiment can be applied is not limited to the printing apparatus 10.

The printing apparatus 10 illustrated in FIG. 1A and FIG. 1B is what is termed as a multifunction peripheral including a reading part 12, which is capable of reading a document that is set on a platen glass, and a printing part 14, which performs printing on a print medium, based on information read by the reading part 12, information input from an external device, or the like.

The reading part 12 is located above the printing apparatus 10, and the printing part 14 is located below the printing apparatus 10. The printing part 14 includes an accommodation tray 16, which accommodates a print medium M, a feeder roller 18, which feeds a print medium M accommodated in the accommodation tray 16, and a guide part 20, which guides a fed print medium M to the printing position at which printing is performed by the print head 26 (described later). Further, the printing part 14 includes a conveyance roller 22, which conveys a print medium M fed via the guide part 20, a platen 24, which supports the print medium M conveyed by the conveyance roller 22, a print head 26, which ejects ink onto the print medium M supported by the platen 24. Moreover, the printing part 14 includes a discharge roller 30, which discharges the print medium M on which printing has been performed to a discharge tray 28, an ink storage part 32, which stores ink to be supplied to the print head 26 via a tube (not illustrated in the drawings).

It is both possible that the print head 26 is capable of ejecting ink of multiple colors and is capable of ejecting ink of only one color. Further, a configuration capable of ejecting a treatment liquid for imparting a predetermined effect to an image after printing is possible as well. In a case where multiple types of ink (including a treatment liquid) are ejected, multiple ink storage parts 32 for respectively storing different kinds of ink are to be disposed. Further, the print head 26 is mounted on a carriage 34. The carriage 34 is configured to be reciprocally movable in the X direction. A print medium M accommodated in the accommodation tray 16 is conveyed in the −Y direction by the feeder roller 18, makes a U-turn because of the guide part 20, and is conveyed in the +Y direction by the conveyance roller 22.

In the printing apparatus 10, the print head 26 ejects ink onto the print medium M supported by the platen 24 while moving via the carriage 34 in the X direction, so as to perform the printing operation for performing printing corresponding to one scan on the print medium M. Next, the conveyance operation for conveying the print medium by a predetermined amount in the +Y direction so that an area on which printing has not been performed at all is located at the position where the print medium M faces the print head 26 is performed. Thereafter, the printing operation is performed again. In this way, the printing apparatus 10 prints a predetermined image on a print medium M by repeatedly executing the printing operation and the conveyance operation.

Figure 2A:
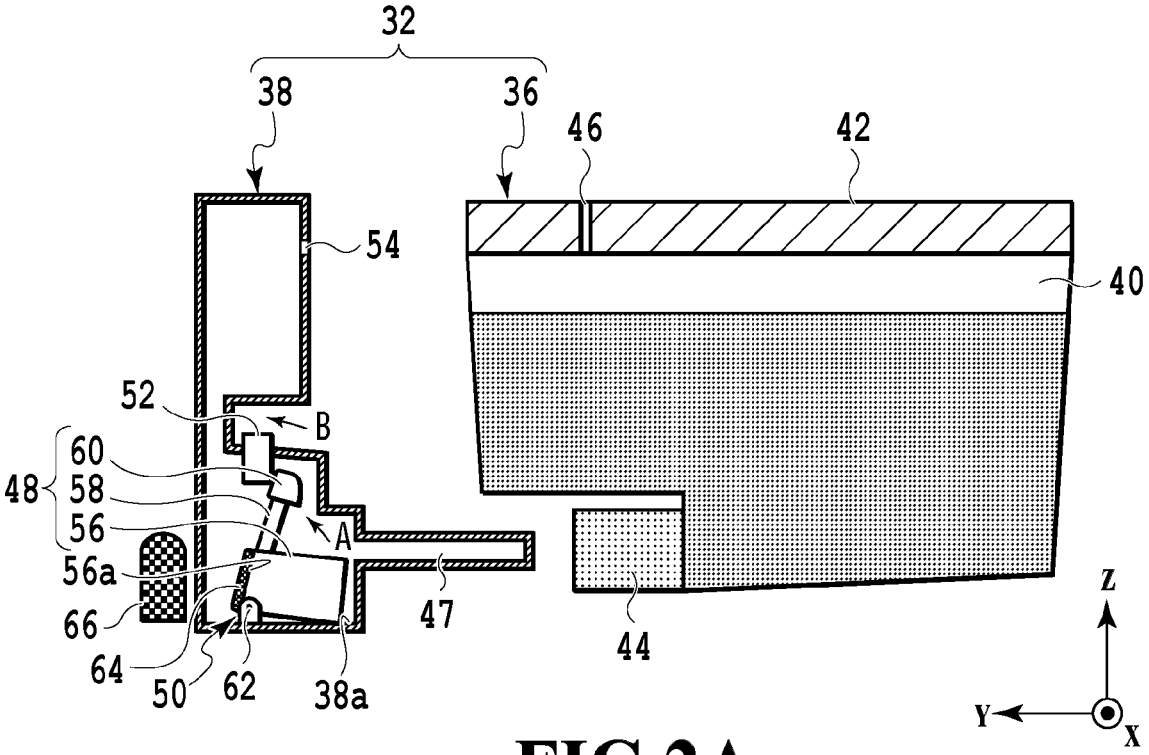
FIG. 2A and FIG. 2B are diagrams illustrating the movement of a pivot member in a case where ink is supplied to an ink chamber.
Figure 2B:
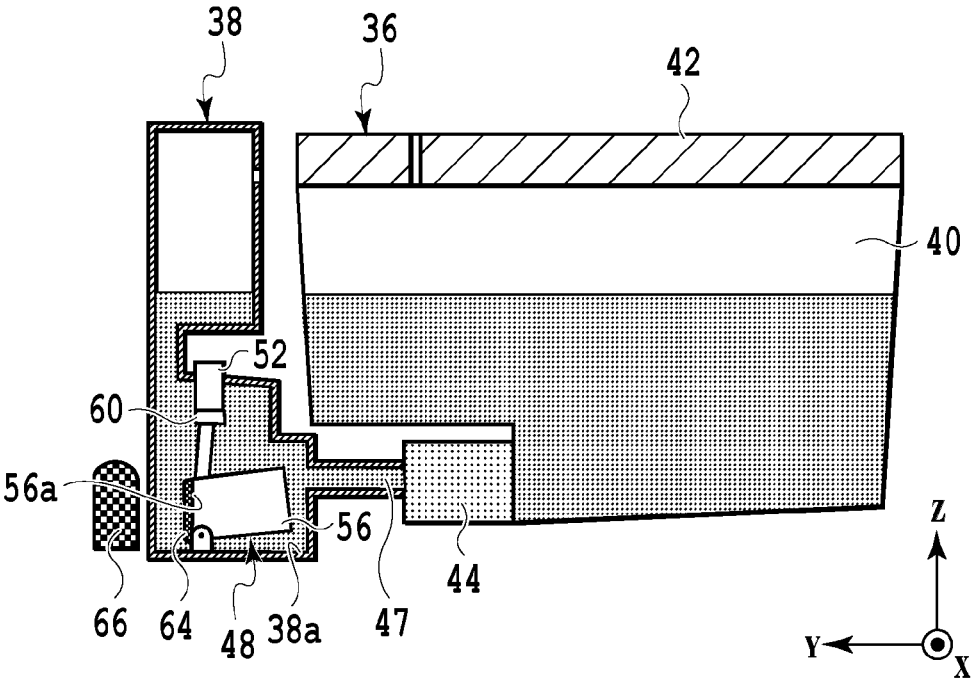

The ink storage part 32 includes an ink containing member 36, in which ink is contained, and an ink chamber 38, which stores ink contained in the ink containing member 36. Here, with reference to FIG. 2A and FIG. 2B, the configuration of the ink storage part 32 will be explained. FIG. 2A and FIG. 2B are schematic configuration diagrams of the ink storage part 32. FIG. 2A indicates a state in which the ink containing member 36 is detached from the ink chamber 38, and FIG. 2B indicates a state in which the ink containing member 36 is mounted on the ink chamber 38.

The ink storage part 32 is disposed for each type of ink to be ejected from the print head 26. Note that each ink storage part 32 has the same configuration regardless of the type of ink. In the ink storage part 32, the ink stored in the ink chamber 38 is supplied to the print head 26 via a tube (not illustrated in the drawings). In a case where ink is supplied from the ink chamber 38 to the print head 26 so that the amount of ink in the ink chamber 38 is reduced, ink is supplied to the ink chamber 38 from the connected ink containing member 36.

The ink containing member 36 includes a main body part 40 and a lid part 42. Ink is contained inside the main body part 40. Further, at the bottom section of the main body part 40, a supply part 44 to be connected to a connecting member 47 (described later) of the ink chamber 38 so as to be capable of supplying ink to the ink chamber 38 is disposed. That is, in the present embodiment, the ink containing member 36 is configured to be detachable from the ink chamber 38 via the supply part 44. The supply part 44 includes a check valve having a valve spring structure or the like. The lid part 42 is formed with an air communication port 46 that allows the inside and the outside of the ink containing member 36 to communicate with each other.

The ink chamber 38 includes the connecting member 47 to be connected to the ink containing member 36 via the supply part 44. At the bottom section 38*a* inside the ink chamber 38, a pivot member 48 is disposed. The pivot member 48 is supported by the support member 50 at the bottom section 38*a* in a revolvable manner. Therefore, in a case where the liquid is supplied to the ink chamber 38, the pivot member 48 is in a state of being immersed in the liquid. Further, inside the ink chamber 38, a sensor 52 capable of detecting a pivotal movement of the pivot member 48 is disposed above the pivot member 48. The ink chamber 38 is formed with an air communication port 54 that allows the inside and the outside of the ink chamber 38 to communicate with each other at a position that the liquid surface of the stored ink does not reach.

The pivot member 48 includes a float 56 extending in the Y direction, an arm part 58 extending upward (approximately Z direction) from the float 56, and a detected part 60 located at the tip of the arm part 58. The float 56 is formed of a material having a specific gravity smaller than that of the ink contained in the ink containing member 36. Further, the float 56 is supported in a revolvable manner by a shaft 62 extending in the X direction in the support member 50 at the lower end portion on one side of the extending direction (Y direction). The detected part 60 is located on the upper side of the float 56 via the arm part 58. Therefore, the detected part 60 is configured to be movable according to the pivotal movement of the float 56. The detected part 60 is formed of a material that can be detected by the sensor 52. Note that, as will be described later, since the sensor 52 is an optical sensor including a light-emitting part and a light-receiving part in the present embodiment, the detected part 60 is formed of a material that blocks or attenuates the light from the light-emitting part.

The sensor 52 is a detection unit that detects the pivotal movement of the pivot member 48, in order to optically detect that the liquid surface of the ink stored in the ink chamber 38 has reached a predetermined position or higher. More specifically, the sensor 52 includes the light-emitting part (not illustrated in the drawings) and the light-receiving part (not illustrated in the drawings). In FIG. 2A and FIG. 2B, the light-emitting part and the light-receiving part are arranged so as to face each other with an interval in the X direction. Note that, in a case where the pivot member 48 makes a pivotal movement, the detected part 60 passes between the light-emitting part and the light-receiving part. Further, the sensor 52 outputs different detection signals according to the light received by the light-receiving part out of the light output from the light-emitting part.

Specifically, for example, in a case where the light that is output from the light-emitting part cannot be received by the light-receiving part, that is, in a case where the received-light intensity is lower than a predetermined intensity, the sensor 52 outputs a low-level signal, which represents a signal of a signal level lower than a threshold level. The output low-level signal is received by a control part (not illustrated in the drawings) mounted on the main PCB (not illustrated in the drawings). The control part that has received the low-level signal detects that the height of the liquid surface of ink is equal to or higher than a predetermined position.

On the other hand, in a case where the light that is output from the light-emitting part can be received by the light-receiving part, that is, in a case where the received-light intensity is equal to or higher than the predetermined intensity, the sensor 52 outputs a high-level signal, which represents a signal of a signal level equal to or higher than the threshold level. The output high-level signal is received by the control part, and the control part detects that the height of the liquid surface of ink is lower than the predetermined position.

In a case where the ink containing member 36 is connected to the connecting member 47 of an ink chamber 38 with no ink stored (see FIG. 2A) via the supply part 44, the ink inside the ink containing member 36 flows to the inside of the ink chamber 38 via the supply part 44 and the connecting member 47. In a case where a certain amount of ink is stored in the ink chamber 38, the buoyancy that acts on the float 56, which has a specific gravity smaller than that of the ink, exceeds the gravity, so that the pivot member 48 (float 56) pivotally moves in the direction of Arrow A. By the pivotal movement of the pivot member 48 in the direction of Arrow A, the detected part 60 moves in the direction of Arrow B.

Then, in a case where the height of the liquid surface of the ink in the ink chamber 38 reaches the predetermined position or higher due to a further inflow of ink, the detected part 60 moves in the direction of Arrow B to the position between the light-emitting part and the light-receiving part of the sensor 52. By the height of the liquid surface of the ink in the ink chamber 38 reaching the predetermined position or higher, it indicates, in other words, that a predetermined amount of ink is stored in the ink chamber 38. Note that, during the time in which the height of the liquid surface of the ink is equal to or higher than the predetermined position, the detected part 60 stays between the light-emitting part and the light-receiving part (see FIG. 2B). In this way, in a case where the height of the liquid surface of the ink is equal to or higher than the predetermined position, since the light that is output from the light-emitting part is not received by the light-receiving part (or is attenuated before reaching the light-receiving part) due to the detected part 60, the sensor 52 outputs the low-level signal to the control part. Accordingly, the control part detects that the height of the liquid surface of the ink is equal to or higher than the predetermined position.

Figure 3A:
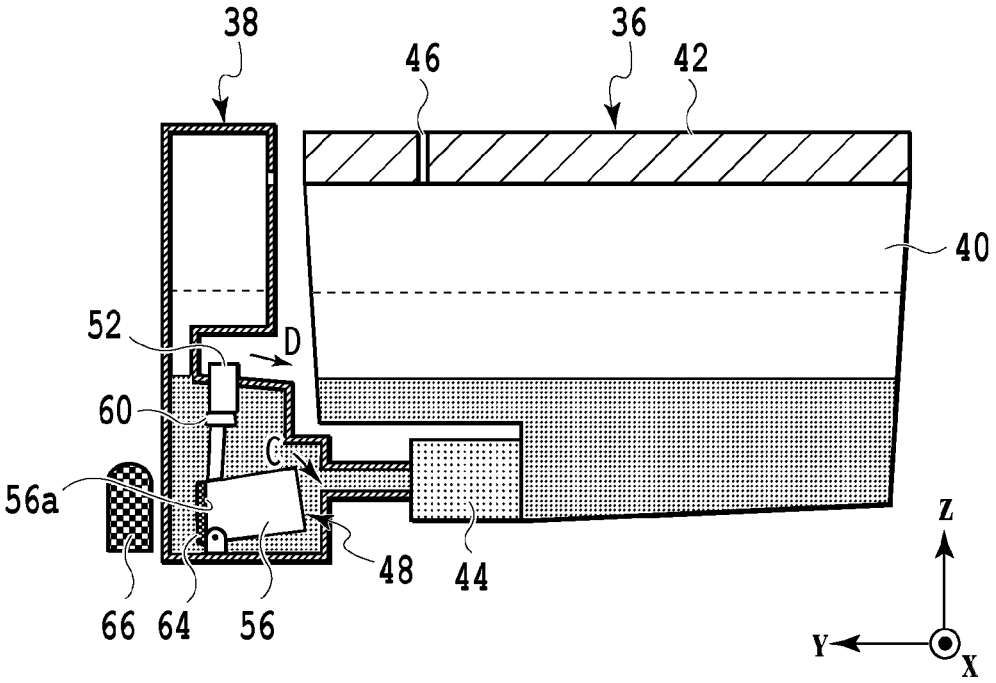
FIG. 3A and FIG. 3B are diagrams illustrating the movement of the pivot member in a case where the amount of ink stored in the ink chamber is reduced.
Figure 3B:
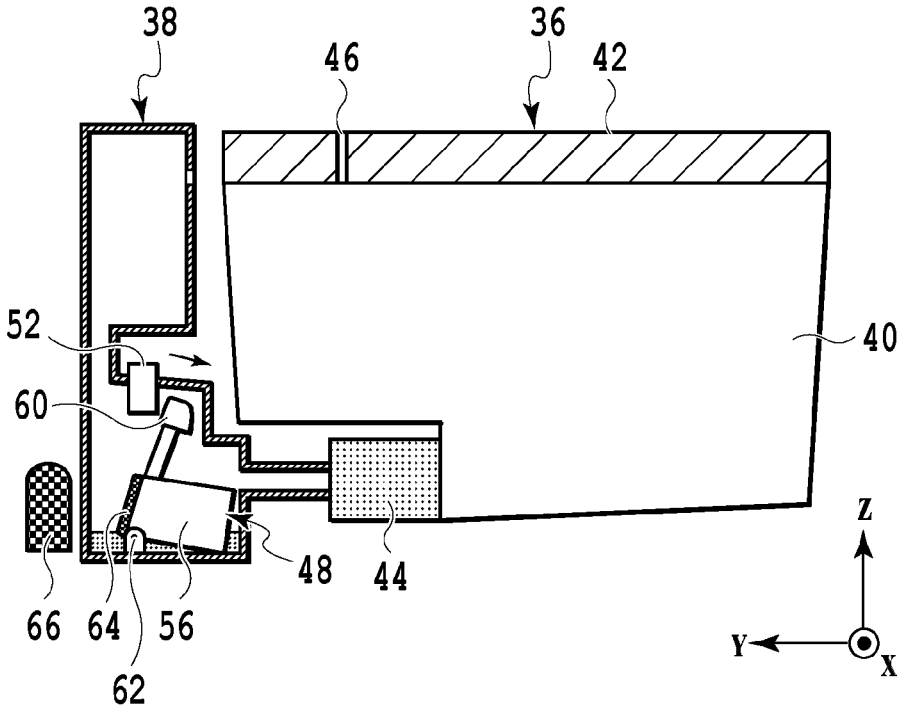

FIG. 3A and FIG. 3B are diagrams for explaining the operation of the pivot member 48 in a case where the amount of ink in the ink chamber 38 is reduced. FIG. 3A is a diagram illustrating the pivot member 48 in a case where the liquid surface of the ink in the ink chamber 38 is equal to or higher than the predetermined position, and FIG. 3B is a diagram illustrating the pivot member 48 in a case where the liquid surface of the ink in the ink chamber 38 is lower than the predetermined position.

Due to a supply of ink from the ink chamber 38 to the print head 26, the amount of ink inside the ink chamber 38 and the ink containing member 36 is reduced, so that the liquid surface of the ink in the ink chamber 38 is lowered (see FIG. 3A). In a case where the amount of ink in the ink chamber 38 is reduced and the amount of stored ink becomes less than a certain amount, the gravity exceeds the buoyancy acting on the float 56. Accordingly, the pivot member 48 (float 56) pivotally moves in the direction of Arrow C. By this pivotal movement of the pivot member 48 in the direction of Arrow C, the detected part 60 moves in the direction of Arrow D.

Then, in a case where the height of the liquid surface of the ink in the ink chamber 38 becomes lower than the predetermined position due to a further supply of ink to the print head 26, the detected part 60 moves in the direction of Arrow D to a position where the detected part 60 is retracted from between the light-emitting part and the light-receiving part of the sensor 52. Note that, during the time in which the height of the liquid surface of the ink is lower than the predetermined position, the detected part 60 stays at the position where the detected part 60 is retracted from between the light-emitting part and the light-receiving part (see FIG. 3B). In this way, in a case where the height of the liquid surface of the ink is lower than the predetermined position, since the light that is output from the light-emitting part can be received by the light-receiving part (or is not attenuated before reaching the light-receiving part), the sensor 52 outputs the high-level signal to the control part. Accordingly, the control part detects that the height of the liquid surface of the ink is lower than the predetermined position.

Here, at the point in time where the printing apparatus 10 detects that the height of the liquid surface of the ink becomes lower than the predetermined position, a notification for prompting the user to replace the ink containing member 36 is provided to a display part 17 (see FIG. 1A) which is disposed on the printing apparatus 10, for example. The user normally checks the notification displayed on the display part 17 and replaces the ink containing member 36. However, depending on the usage conditions, the ink containing member 36 may be let stand whereas the height of the liquid surface of the ink has become lower than the predetermined position. In particular, in a case where the liquid surface of the ink has become as low as the shaft 62 (see FIG. 3B), a part of the shaft 62 is exposed to the atmosphere. If this state is further let stand for a long period of time, the ink remaining near the shaft 62 becomes thickened, and finally the ink around the shaft 62 is solidified. Accordingly, there is a possibility that the pivotal movement of the pivot member 48 is hindered, and whether or not the height of the liquid surface of the ink is equal to or higher than the predetermined position, that is, whether or not the remaining ink amount of the ink chamber 38 is equal to or lower than a predetermined amount cannot be accurately detected.

Therefore, in the present embodiment, a magnetic member 64 is disposed on the first side surface 56*a* of the float 56, and an electromagnet 66 is disposed at a position facing the magnetic member 64 via the wall of the ink chamber 38 (see FIG. 2A, FIG. 2B, FIG. 3A, and FIG. 3B). This electromagnet 66 is controlled by the control part to be energized, so that a magnetic force is generated. The magnetic member 64 and the electromagnet 66 configure a pivot unit. The first side surface 56*a* of the float 56, on which the magnetic member 64 is disposed, is an end surface corresponding to the +Y direction in the vicinity of the support member 50. That is, with respect the float 56, the magnetic member 64 is disposed on the side closer to the support member 50 than to the center of gravity of the float 56. With such a configuration, the pivot member 48 is attracted to the electromagnet 66 side by the magnetic force of the electromagnet 66, so that the posture of the detected part 60 changes from a posture in which the detected part 60 is retracted from between the light-emitting part and the light-receiving part of the sensor 52 to a posture in which the detected part 60 is located therebetween. Note that, by arranging the magnetic member 64 on the first side surface 56*a*, the effect which is caused on the pivotal movement of the pivot member 48 by the increase in gravity of the float 56 due to the magnetic member 64 can be prevented.

Figure 4A:
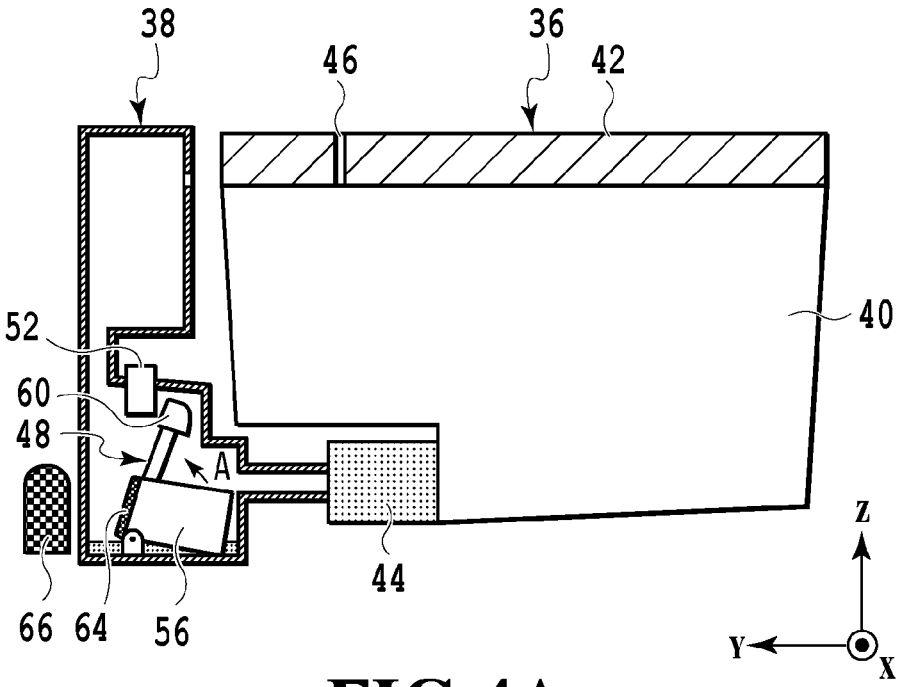
FIG. 4A and FIG. 4B are diagrams for explaining forced pivotal movement in the printing apparatus according to the first embodiment.
Figure 4B:
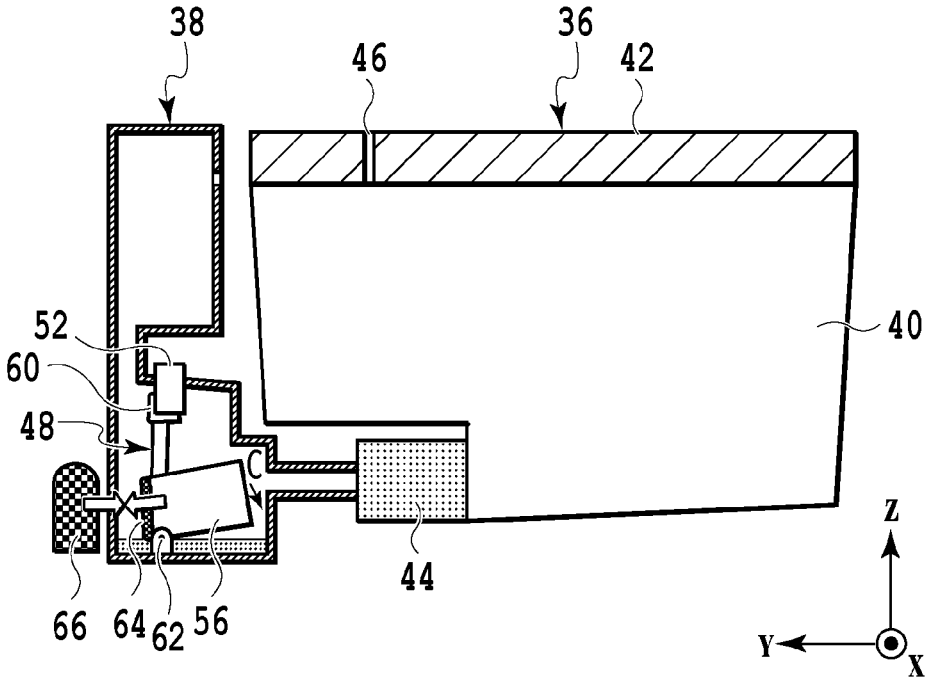

FIG. 4A and FIG. 4B are diagrams for explaining forced pivotal movement that the pivot member 48 is made to perform by use of the electromagnet 66. FIG. 4A is a diagram illustrating a posture of the pivot member 48 in a case where the height of the liquid surface of the ink is lower than the predetermined position, and FIG. 4B is a diagram illustrating a posture of the pivot member 48 in a case where the electromagnet 66 is energized. In a case where the height of the liquid surface of the ink in the ink chamber 38 becomes lower than the predetermined position, the gravity exceeds the buoyancy acting on the float 56 of the pivot member 48 as illustrated in FIG. 4A, so that the detected part 60 turns into a posture in which the detected part 60 is retracted from between the light-emitting part and the light-receiving part of the sensor 52. As described above, if this state is let stand for a long period of time, there is a possibility that the ink around the shaft 62 becomes thickened and solidified, so that the pivotal movement of the pivot member 48, which is disposed on the shaft 62 in a revolvable manner, is hindered by the thickened and solidified ink.

Therefore, by energizing the electromagnet 66 so that a magnetic force is generated in the electromagnet 66, the magnetic member 64 disposed on the first side surface 56*a* of the float 56, which faces the ink chamber 38 via the wall, is attracted to the electromagnet 66 side. In a case where the magnetic member 64 is attracted to the electromagnet 66 side, a force in the direction of Arrow A is generated on the pivot member 48, so that the pivot member 48 is forced to make a pivotal movement. Accordingly, the pivot member 48 turns into a posture in which the detected part 60 is located between the light-emitting part and the light-receiving part of the sensor 52 or at a position near there (see FIG. 4B). Thereafter, by de-energizing the electromagnet 66, the magnetic force of the electromagnet 66 is disappeared, so that the attraction of the magnetic member 64 toward the electromagnet 66 side is stopped. Accordingly, a force in the direction of Arrow C is generated on the pivot member 48 due to its own weight. Then, the pivot member 48 pivotally moves in the direction of Arrow C, so that the detected part 60 turns into a posture in which the detected part 60 is retracted from between the light-emitting part and the light-receiving part of the sensor 52 (see FIG. 4A). In this way, in the present embodiment, the magnetic member 64 and the electromagnet 66 function as a pivot unit that forces the pivot member 48 to make a pivotal movement.

In this way, the forced pivotal movement, in which energization of the electromagnet 66 for forcing the pivot member 48 to pivotally move in the direction of Arrow A and then de-energization of the electromagnet 66 for making the pivot member 48 pivotally move in the direction of Arrow C by its own weight are alternately and repeatedly performed, is executed. Accordingly, it is possible to diffuse the thickened ink accumulated near the shaft 62. Therefore, the thickening of the ink in the vicinity of the shaft 62 is eliminated, so that the pivotal movement of the pivot member 48 is prevented from being hindered by thickened and solidified ink. Note that, during the control for energizing the electromagnet 66, the sensor 52 does not transmit a signal to the control part, or the control part does not receive a signal from the sensor 52.

The forced pivotal movement of the pivot member 48 by use of the electromagnet 66 can be executed at various timings. For example, the forced pivotal movement is executed for a certain period of time at a timing after a prompt of replacement of the ink containing member 36 and where a predetermined period of time elapses without replacement of the ink containing member 36. Note that the timing and length of the forced pivotal movement are set according to the type of ink to be used, the working environment, etc.

Although not particularly described in the above-described embodiment, it is also possible that the magnetic member 64 is formed on the full surface or a part of the first side surface 56*a* of the float 56 as long as the pivot member 48 is revolvable because of a magnetic force generated by the electromagnet 66. Further, the positional relationship between the magnetic member 64 and the electromagnet 66 is not limited to that in the above-described embodiment. That is, the arrangement positions of the magnetic member 64 and the electromagnet 66 can be anywhere as long as the pivot member 48 can be displaced by energization control on the electromagnet 66 between a posture in which the detected part 60 is retracted from between the light-emitting part and the light-receiving part of the sensor 52 and a posture in which the detected part 60 is located therebetween.

As explained above, in the printing apparatus 10, the magnetic member 64 is disposed on the pivot member 48, which is disposed in the ink chamber 38, and the electromagnet 66 is disposed at the position facing the magnetic member 64 via the wall of the ink chamber 38. Accordingly, it is possible to force the pivot member 48 to make a pivotal movement, so that the thickened ink around the shaft 62, which supports the pivot member 48 in a revolvable manner, can be diffused. Therefore, it is possible to prevent the pivotal movement of the pivot member 48 from being hindered by thickened ink and solidified ink around the shaft 62. Therefore, in the printing apparatus 10, even though the ink around the shaft 62 in the support member 50, which supports the pivot member 48 in a revolvable manner, is thickened or solidified, it is possible to prevent deterioration in the function of detecting the ink remaining amount.

Second Embodiment

Next, with reference to FIG. 5A and FIG. 5B, an explanation will be given of a printing apparatus according to the second embodiment. Note that, in the following explanation, as in the above-described first embodiment, a printing apparatus that ejects ink onto a print medium for printing is taken as an example for the sake of explanation. In addition, the same or corresponding configurations as those of the printing apparatus according to the above-described first embodiment are assigned with the same signs, so as to omit detailed explanations thereof as appropriate.

The printing apparatus 10 according to the second embodiment is different from the printing apparatus according to the above-described first embodiment in that a flow is generated to the ink so as to make the pivot member 48 pivotally move in a state where the height of the liquid surface of the ink in the ink chamber 38 is equal to or higher than a predetermined position.

Figure 5A:
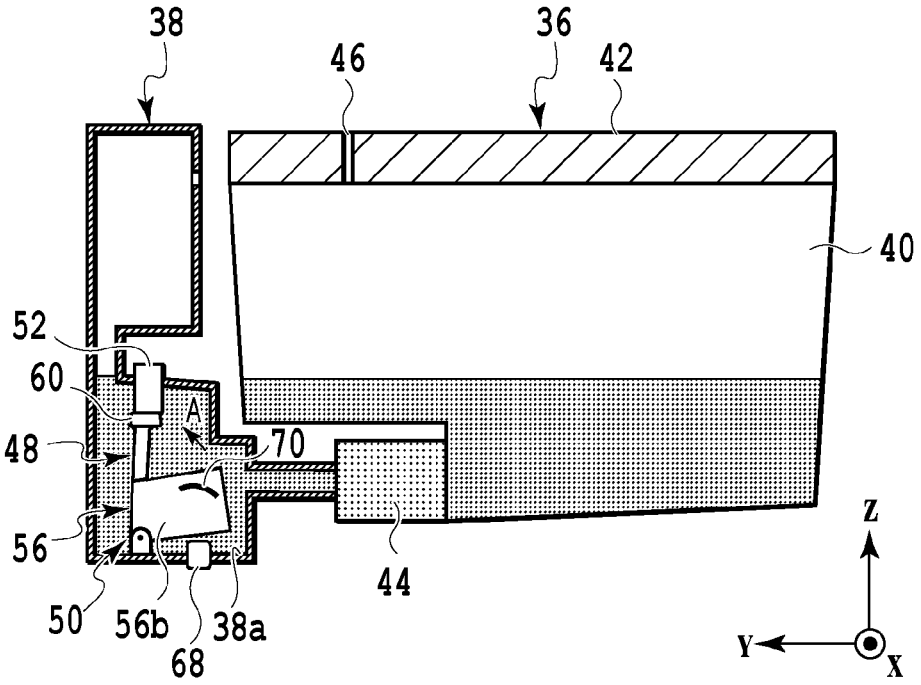
FIG. 5A and FIG. 5B are diagrams for explaining forced pivotal movement in the printing apparatus according to the second embodiment.
Figure 5B:
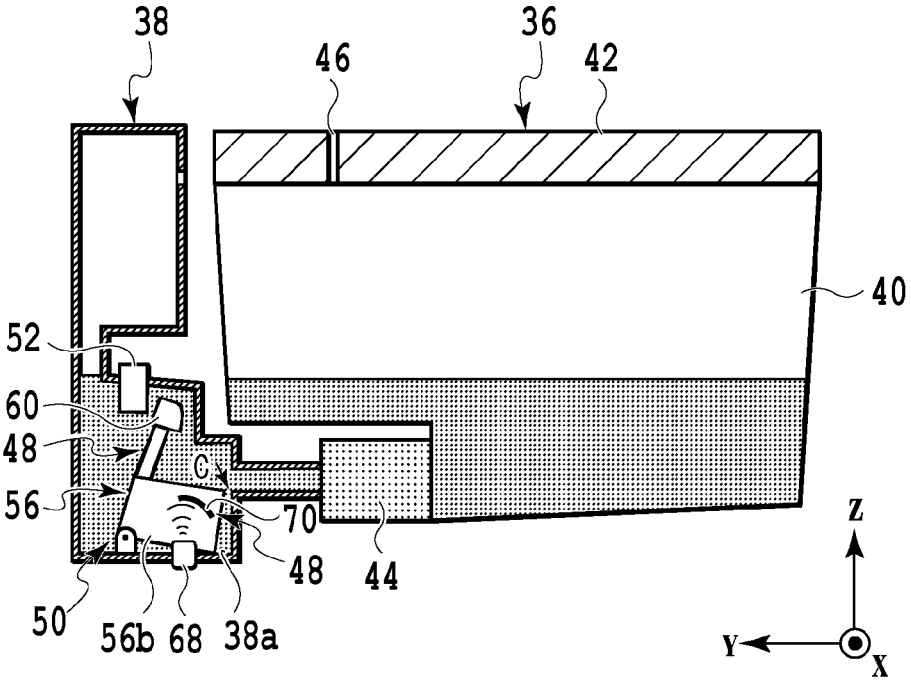

FIG. 5A and FIG. 5B are diagrams for explaining forced pivotal movement according to the second embodiment. FIG. 5A is a diagram illustrating a posture of the pivot member 48 in a case where the height of the liquid surface of the ink is equal to or higher than the predetermined position, and FIG. 5B is a diagram illustrating a posture of the pivot member 48 in a case where an ink flow is generated. Specifically, the printing apparatus 10 according to the second embodiment includes an ink flow generation part 68 that generates a flow to the stored ink in the ink chamber 38. Further, the pivot member 48 includes a receiver part 70 that receives the ink flow generated by the ink flow generation part 68 so that the pivot member 48 is forced to make a pivotal movement. Note that, in the printing apparatus 10 according to the present embodiment, the magnetic member 64 and the electromagnet 66 are not disposed.

For example, the ink flow generation part 68 is configured to be capable of generating an ink flow by ejecting ink into the stored ink in the ink chamber 38 in which ink is stored. The specific configuration for ejecting ink may be, but not limited to, a configuration using a solenoid valve, a piezo element, or thermal foaming. Further, the configuration of the ink flow generation part 68 is not limited to a configuration in which an ink flow is generated by ejecting ink, but can be any configuration as long as it is possible to generate a flow to the ink stored in the ink chamber 38. The driving of the ink flow generation part 68 is controlled by the control part so as to generate an ink flow.

In the present embodiment, the ink flow generation part 68 is disposed in the vicinity of the end portion on another side of the float 56 which is not supported by the support member 50 at the bottom section 38*a* of the ink chamber 38 Further, the ink flow generation part 68 is disposed at a position that overlaps with the float 56 in the Y direction and does not overlap with the float 56 in the X direction. Accordingly, the ink flow generated by the ink flow generation part 68 does not directly hit the float 56.

The receiver part 70 is fixedly disposed on the second side surface 56*b* of the float 56, which extends in the Y direction, at a position that overlaps with the ink flow generation part 68 in the X direction and the Y direction. The receiver part 70 has a shape that receives the ink flow generated by the ink flow generation part 68, so as to be capable of making the pivot member 48 pivotally move from a posture in which the detected part 60 is located between the light-emitting part and the light-receiving part of the sensor 52 to a posture in which the detected part 60 is retracted from therebetween. Note that it is both possible that the ink flow generation part 68 and the receiver part 70 are disposed on one side of the float 56 and on both sides of the float 56 with respect to the X direction.

As for the above-described configuration, a case in which forced pivotal movement of the pivot member 48 is performed will be explained. As illustrated in FIG. 5A, if the height of the liquid surface of the ink in the ink chamber 38 is equal to or higher than the predetermined position, such a force to make the pivot member 48 pivotally move in the direction of Arrow A is generated due to the buoyancy generated to the float 56. At this time, if thickened ink or the like is attached around the shaft 62, the pivot member 48 may not be able to pivotally move to make the detected part 60 properly located between the light-emitting part and the light-receiving part of the sensor 52.

Therefore, from this state, an ink flow is generated by the ink flow generation part 68. Then, the receiver part 70 disposed on the second side surface 56*b* of the float 56 receives the generated ink flow. Accordingly, a force in the direction of Arrow C is generated to the pivot member 48, so that the pivot member 48 is forced to make a pivotal movement so as to be in a posture in which the detected part 60 is completely retracted from between the light-emitting part and the light-receiving part of the sensor 52 (see FIG. 5B). Thereafter, the driving of the ink flow generation part 68 is stopped. Accordingly, the ink flow disappears, and a force in the direction of Arrow A is generated to the pivot member 48 because of the buoyancy of the float 56, so that the pivot member 48 makes a pivotal movement so as to be in a posture in which the detected part 60 is located between the light-emitting part and the light-receiving part of the sensor 52 or in a posture similar to that (see FIG. 5A). In this way, in the present embodiment, the ink flow generation part 68 and the receiver part 70 function as a pivot unit that forces the pivot member 48 to make a pivotal movement.

In this way, the forced pivotal movement, in which driving of the ink flow generation part 68 for forcing the pivot member 48 to pivotally move in the direction of Arrow C and stopping of the ink flow generation part 68 for making the pivot member 48 pivotally move in the direction of Arrow A because of the buoyant of the float 56 are alternately and repeatedly performed, is executed. Accordingly, it is possible to diffuse the thickened ink accumulated near the shaft 62. Therefore, the thickening of the ink in the vicinity of the shaft 62 is eliminated, so that it is possible that the pivotal movement of the pivot member 48 is prevented from being hindered by thickened or solidified ink. Note that, during the control for driving the ink flow generation part 68, the sensor 52 does not transmit a signal to the control part, or the control part does not receive a signal from the sensor 52.

Further, the forced pivotal movement of the pivot member 48 by use of the ink flow generation part 68 can be executed at various timings. For example, the forced pivotal movement is executed for a certain period of time at a timing where the ink containing member 36 is replaced and such an amount of ink that the liquid surface becomes equal to or higher than the predetermined position is stored in the ink chamber 38 (for example, the determination is made based on the time period after an ink containing member 36 is connected to the ink chamber 38). Note that the timing and length of the forced pivotal movement are set according to the type of ink to be used, the working environment, etc.

Although not particularly described in the above-described embodiment, the ink flow generation part 68 and the receiver part 70 are not limited to those in the above-described embodiment. That is, the ink flow generation part 68 and the receiver part 70 can be arranged in any ways as long as the pivot member 48 can be displaced by the generated ink flow from a posture in which the detected part 60 is located between the light-emitting part and the light-receiving part of the sensor 52 to a posture in which the detected part 60 is retracted from therebetween.

Further, although the receiver part 70 is configured to receive an ink flow generated by the ink flow generation part 68 so that the pivot member 48 makes a pivotal movement in the above-described embodiment, the present embodiment is not limited as such. That is, it is also possible that at least one of the float 56, the arm part 58, and the detected part 60 is configured to directly receive an ink flow generated by the ink flow generation part 68 so that the pivot member 48 makes a pivotal movement.

As explained above, in the printing apparatus 10, the ink flow generation part 68, which generates an ink flow, and the receiver part 70, which is capable of receiving the generated ink flow so as to make the pivot member 48 pivotally move, are disposed. Accordingly, it is possible to force the pivot member 48 to make a pivotal movement in a state where such an amount of ink that the liquid surface is equal to or higher than the predetermined position is stored in the ink chamber 38, so that thickened ink around the shaft 62 can be diffused. Therefore, it is possible to prevent the pivotal movement of the pivot member 48 from being hindered by thickened ink and solidified ink around the shaft 62. Therefore, in the printing apparatus 10, even though the ink around the shaft 62 in the support member 50, which supports the pivot member 48 in a revolvable manner, is thickened or solidified, it is possible to prevent deterioration in the function of detecting the ink remaining amount.

Other Embodiments

Note that the above-described embodiments may be modified as shown in the following (1) through (5).

(1) Although a mechanism for determining whether or not the height of the liquid surface of ink is equal to or higher than a predetermined position, that is, for determining the ink remaining amount is disposed in the ink chamber 38 in the above-described embodiments, the present embodiments are not limited as such. That is, it is also possible that the mechanism for determining the ink remaining amount, such as the pivot member 48 and a mechanism for making the pivot member 48 pivotally move, is disposed in the ink containing member 36. Furthermore, although the electromagnet 66 is disposed outside the ink chamber 38 in the above-described first embodiment, the present embodiment is not limited as such. That is, it is also possible that the electromagnet 66 is disposed inside the ink chamber 38.

(2) Although whether or not the height of the liquid surface of the ink stored in the ink chamber 38 is equal to or higher than a predetermined position is determined by the pivot member 48 and the sensor 52 in the above-described embodiments, the configuration for detecting the ink remaining amount of the ink chamber 38 is not limited as such. That is, such a configuration in which a sensor that is capable of detecting the rotation angle of the pivot member 48 relative to the reference position is disposed so as to detect the remaining amount of ink stored in the ink chamber 38, based on the rotation angle of the pivot member 48, in a phased manner or a continuous manner.

(3) The present disclosure is not only applied to a printing apparatus that performs printing by ejecting ink, but the present disclosure can be widely applied as a liquid ejection apparatus that ejects various kinds of liquid from a liquid ejection head. Further, in the above-described embodiment, the printing apparatus 10 is what is termed as a serial scan type printing apparatus that ejects ink from a print head, which moves in the X direction, onto a print medium, which is conveyed in the Y direction, the printing apparatus 10 is not limited as such. That is, what is termed as a full-line type printing apparatus, which uses a long print head extending over the whole area in the width direction of the printing area in a print medium, can be used as well.

(4) Although a signal is not transmitted from the sensor 52 to the control part or a signal from the sensor 52 is not received by the control part during the time where the forced pivotal movement of the pivot member 48 is executed in the above-described embodiments, the present embodiments are not limited as such. That is, it is also possible that the forced pivotal movement is terminated according to a signal in the control part, which is output from the sensor 52. Accordingly, for example, in a case where reception of a low-level signal during energization to the electromagnet 66 and reception of a high-level signal during de-energization to the electromagnet 66 are repeated by a set number of times, it is determined that thickening of the ink in the vicinity of the shaft 62 is eliminated, and the forced pivotal movement is terminated.

(5) The above-described embodiments and various forms shown in (1) through (4) may be combined as appropriate.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-057121 filed Mar. 27, 2020, which is hereby incorporated by reference wherein in its entirety.

What is claimed is:

1. A liquid ejection apparatus comprising:

a liquid ejection head configured to eject supplied liquid, a storage unit configured to store the liquid to be supplied to the liquid ejection head, wherein the storage unit includes a chamber configured to store the liquid and a containing member configured to be detachable from the chamber and to contain liquid to be supplied to the chamber, and wherein, by attaching the containing member to the chamber, the liquid stored in the containing member flows into the chamber, a pivot member configured to be immersed in the liquid stored in the storage unit and be revolvable according to an amount of the liquid, wherein the pivot member is disposed in the chamber, a support member configured to support the pivot member in a revolvable manner, wherein the support member is disposed at the bottom of inside the storage unit, a detection unit configured to detect the amount of the liquid by use of the pivot member, a pivot unit including a magnetic member disposed on the pivot member, and an electromagnet configured to attract the magnetic member.

2. The liquid ejection apparatus according to claim 1, wherein, in the pivot member, the magnetic member is disposed on a side closer to the support member than to a center of gravity of the pivot member.

3. The liquid ejection apparatus according to claim 1, wherein the pivot member includes a float configured to have a specific gravity smaller than that of the liquid stored in the storage unit and be supported via the support member in a revolvable manner in the storage unit, and a detected part disposed on the float via an arm part and configured to be detectable by the detection unit.

4. The liquid ejection apparatus according to claim 1, wherein in the case that the electromagnet is energized, the magnetic member is attracted to the electromagnet member.

5. A liquid ejection apparatus comprising:

a liquid ejection head configured to eject supplied liquid, a storage unit configured to store the liquid to be supplied to the liquid ejection head, a liquid supply tube configured to supply the liquid from the storage unit to the liquid ejection head, a pivot member configured to be immersed in the liquid stored in the storage unit and be revolvable according to an amount of the liquid, a detection unit configured to detect the amount of the liquid by use of the pivot member, and wherein the storage unit further includes a generation unit configured to generate a flow to the liquid, so that the pivot member in a state of being immersed in the liquid stored in the storage unit can be made to pivotally move.

6. The liquid ejection apparatus according to claim 5, wherein the pivot member includes a receiver part configured to receive the flow of the liquid generated by the generation unit.

7. The liquid ejection apparatus according to claim 6, wherein the receiver part is located to face the generation unit.

8. The liquid ejection apparatus according to claim 5, wherein the pivot member includes a float configured to have a specific gravity smaller than that of the liquid stored in the storage unit and be supported via a support member in a revolvable manner in the storage unit, and a detected part disposed on the float via an arm part and configured to be detectable by the detection unit.

9. The liquid ejection apparatus according to claim 5, wherein the storage unit includes a chamber configured to store the liquid and a containing member configured to be detachable from the chamber and to contain liquid to be supplied to the chamber, and wherein, by attaching the containing member to the chamber, the liquid stored in the containing member flows into the chamber.

10. The liquid ejection apparatus according to claim 9, wherein the pivot member is disposed in the chamber.

11. The liquid ejection apparatus according to claim 9, wherein the pivot member is disposed in the containing member.

* * * * *